United States Patent [19]

Holmqvist

[11] 4,208,163

[45] Jun. 17, 1980

[54] AUTOMATIC QUICK-COUPLING DEVICE

[75] Inventor: Bo H. Holmqvist, Byske, Sweden

[73] Assignee: Renholmens Mekaniska Verkstad AB, Byske, Sweden

[21] Appl. No.: 870,528

[22] Filed: Jan. 18, 1978

[51] Int. Cl.[2] ..... E02F 3/96

[52] U.S. Cl. ..... 414/723; 280/421; 414/607

[58] Field of Search ..... 214/145 A, 140, 620; 172/212; 280/421; 414/607, 697, 723, 724

[56] References Cited

U.S. PATENT DOCUMENTS 3,243,066 3/1966 Gardner ..... 214/145 A

*Primary Examiner*—Stephen G. Kunin
*Assistant Examiner*—George F. Abraham
*Attorney, Agent, or Firm*—Cushman, Darby & Cushman

[57] ABSTRACT

A coupling between a tool attachment adapted to be supported on a carrier and a tool mount fitting the tool attachment and adapted to support a tool, the tool mount carrying a fixed latch member and the tool attachment carrying a movable latch member which, when the tool attachment and the tool mount are in engagement, is movable into and out of locking engagement with the fixed latch member; a device for moving the latch member between locking and unlocking positions to thereby couple and decouple, respectively, the tool attachment and the tool mount; a hydraulic control circuit for supplying power to a tool supported on the tool mount, the circuit including a pair of two-part hose couplings, one part of each coupling being stationary on the tool mount and the other part carried on and movable relative to the tool attachment; and a device for moving the movable hose coupling parts relative to the tool attachment, in response to locking and unlocking movement of the movable latch member, in a manner such that during a coupling operation the hose coupling parts of each pair become engaged only after the movable latch member has arrived at a locking position and such that during a decoupling operation the coupling parts of each pair become disengaged before the movable locking member moves out of its locking position.

7 Claims, 12 Drawing Figures

AUTOMATIC QUICK-COUPLING DEVICE

This invention relates to a quick-coupling device for automatically coupling a tool attachment supported on a loader or other tool carrier to a tool and particularly a tool of the kind, which comprises means to be controlled hydraulically from the tool carrier.

Coupling devices of this kind and in different designs are previously known, but all of these known devices provide only the possibility of locking the tool attachment to the tool in a mechanical way. For tools comprising hydraulic functions it was heretofore necessary to carry out the coupling of the hydraulic control system manually by coupling together a number of hoses, which to some extent takes away the advantage of the mechanical locking, because the driver yet has to leave the loader for coupling the hydraulic control system.

The present invention, therefore, has the object to solve this problem and to produce an automatic quick-coupling device of such a nature, that the hydraulic control system is coupled automatically at the same time when the tool attachment mechanically is being locked to the tool. This object is achieved thereby that the present invention has been given the characterizing features defined in the attached claims.

Figure 1:
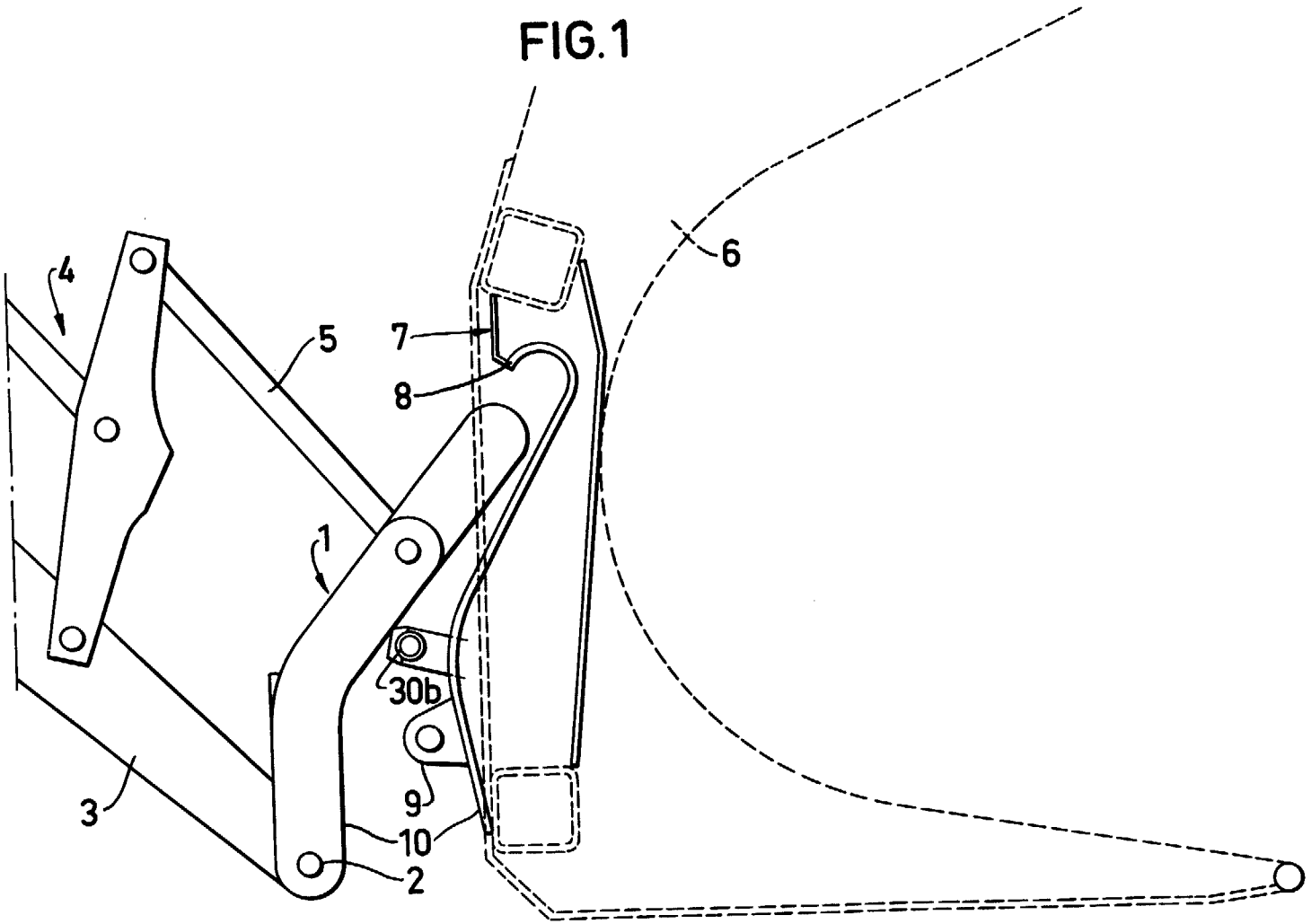
Figure 2:
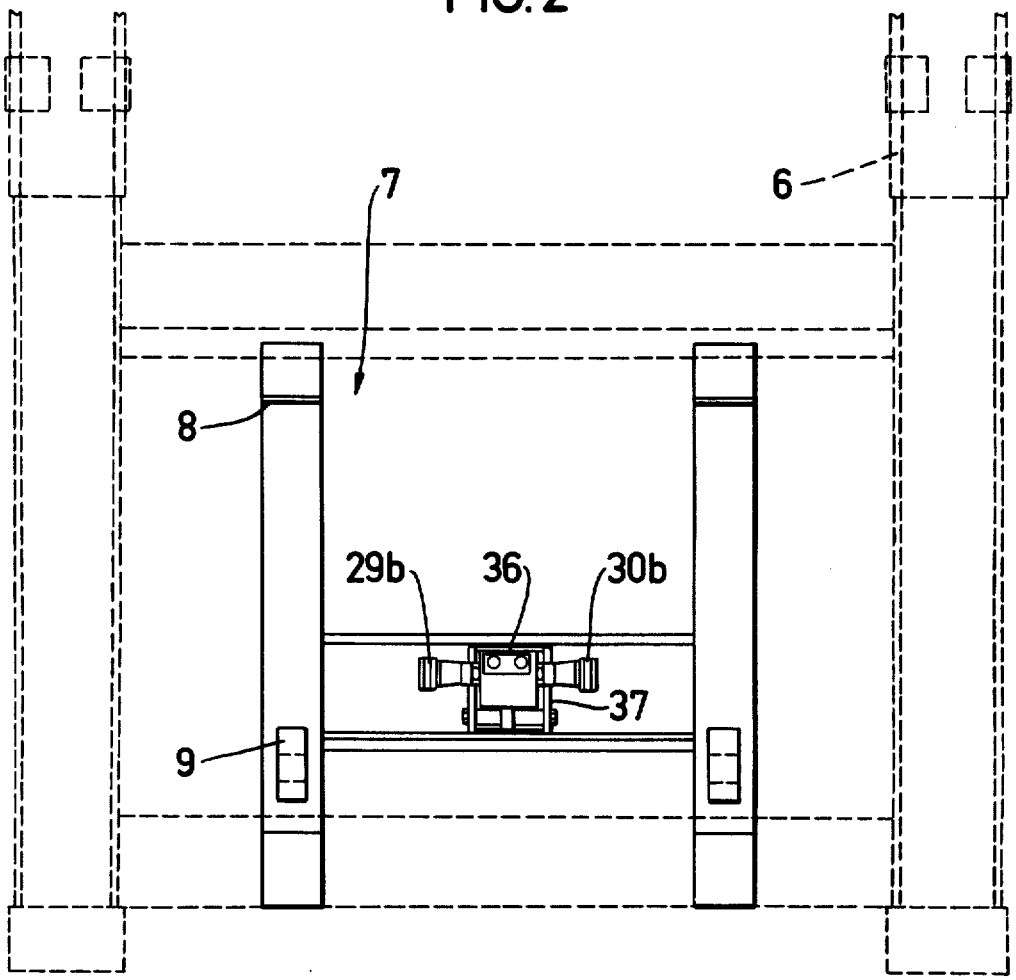
Figure 3:
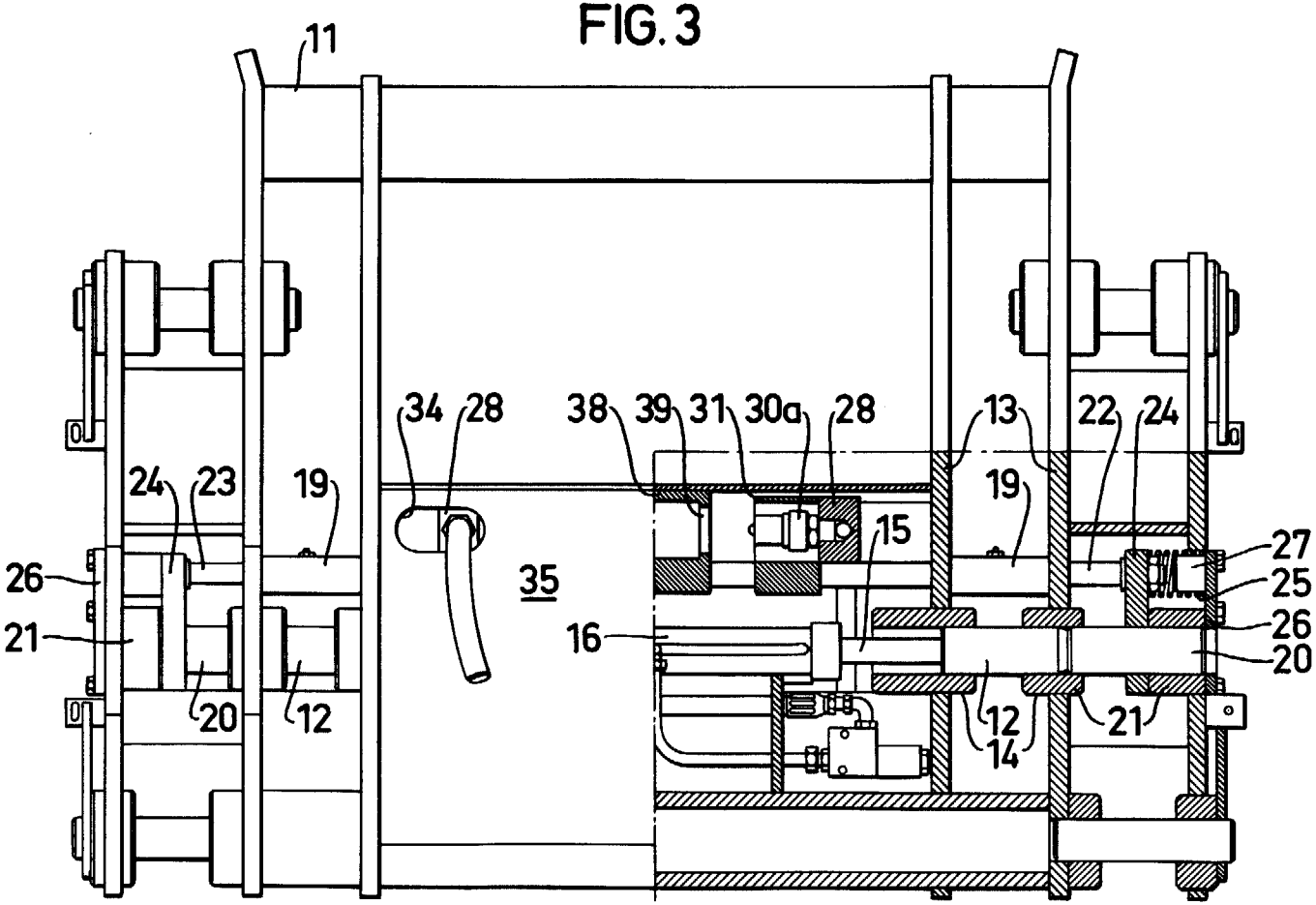
Figure 4:
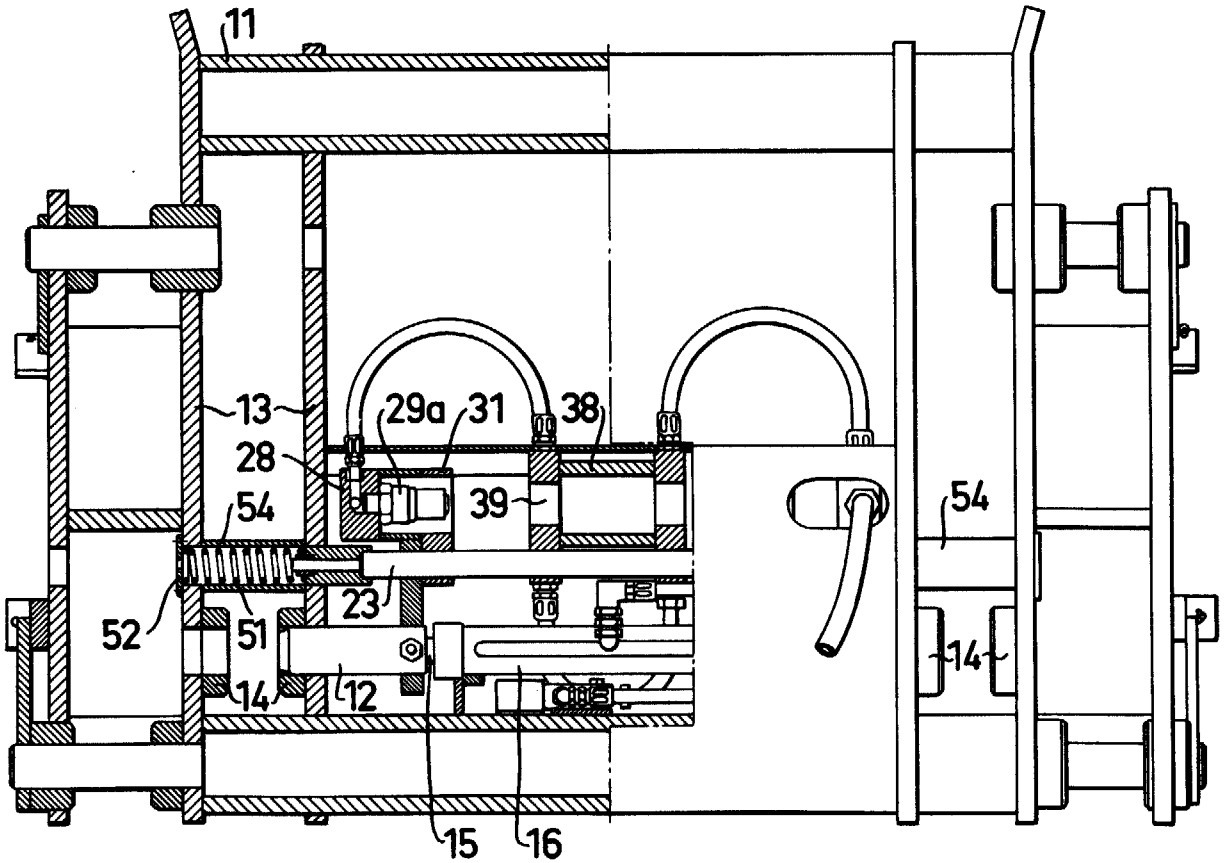
Figure 5:
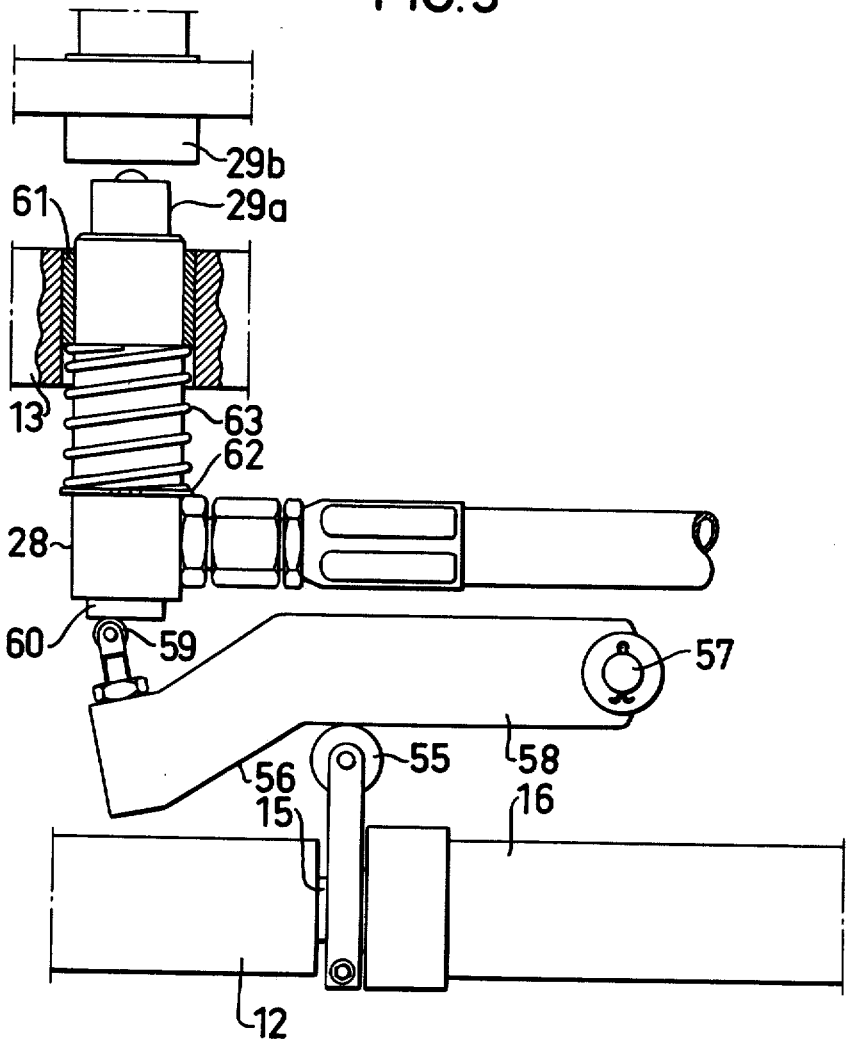
Figure 6:
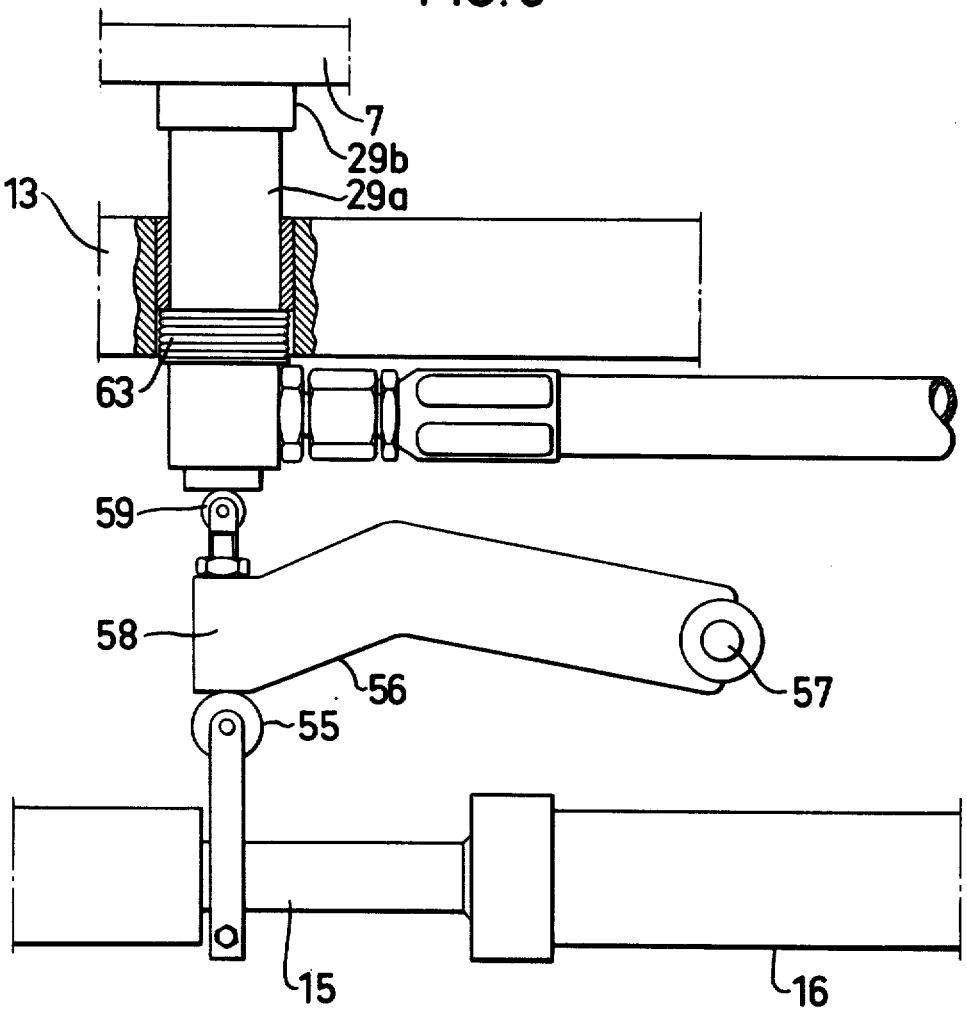
Figure 7:
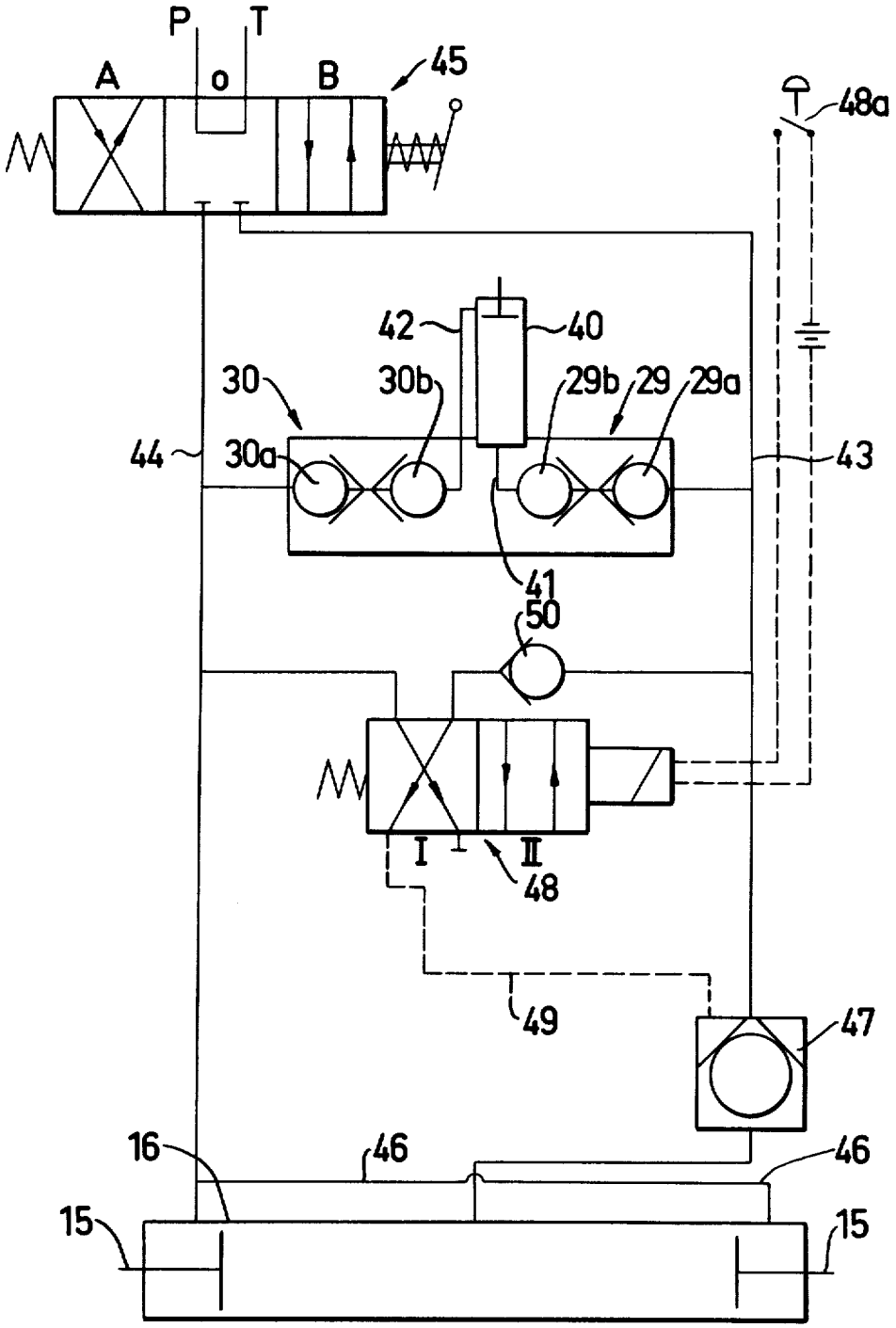
Figure 8:
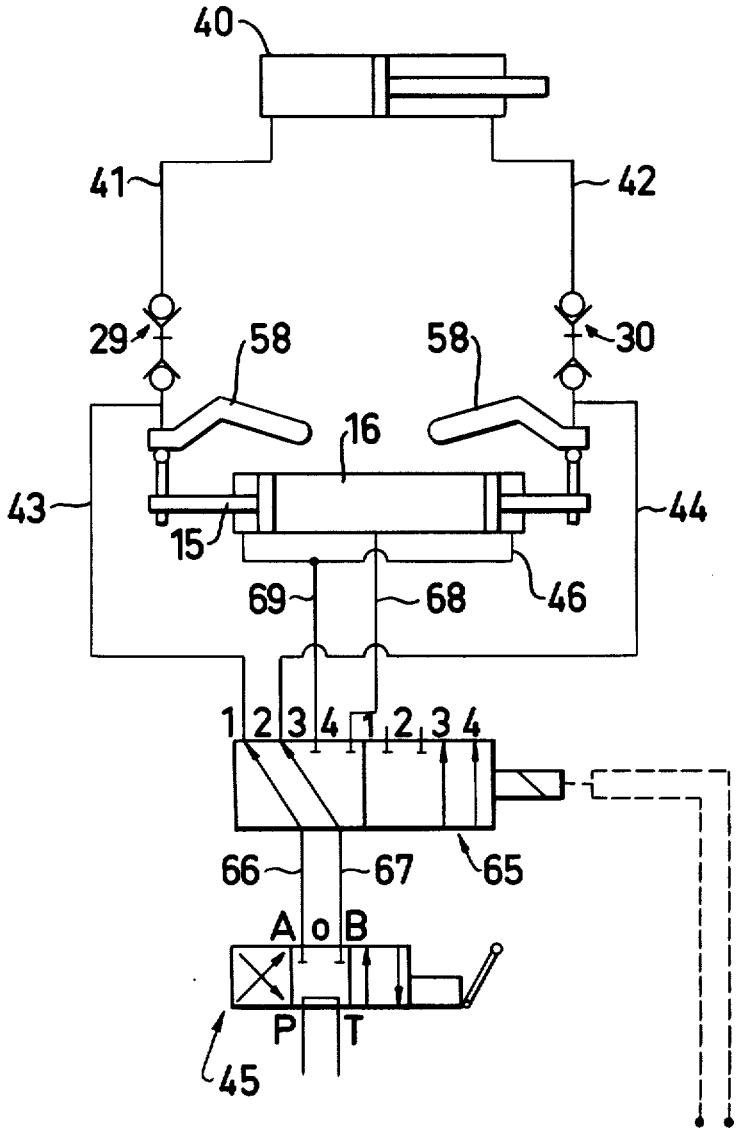

The invention is described in greater detail in the following, with reference to the accompanying drawings, in which FIG. 1 is a lateral view of a tool attachment supported on the lifting arms of a loader and of a tool with a mounting means for the tool attachment in a position immediately before said two parts are coupled together, FIG. 2 is an end view of the mounting means of the tool, FIG. 3 is an end view, partially in section, of the tool attachment, illustrating a first embodiment of the automatic quick-coupling device according to the invention, FIG. 4 is an end view similar to that shown in FIG. 3, but of a modified embodiment of the invention, FIGS. 5 and 6 show certain parts of a further embodiment of the quick-coupling device according to the invention in disengaged and coupled position, respectively, FIG. 7 is a hydraulic coupling diagram for the quick-coupling device according to the invention, and FIG. 8 is an alternative coupling diagram especially for the embodiment shown in FIGS. 5 and 6.

Figure 9:
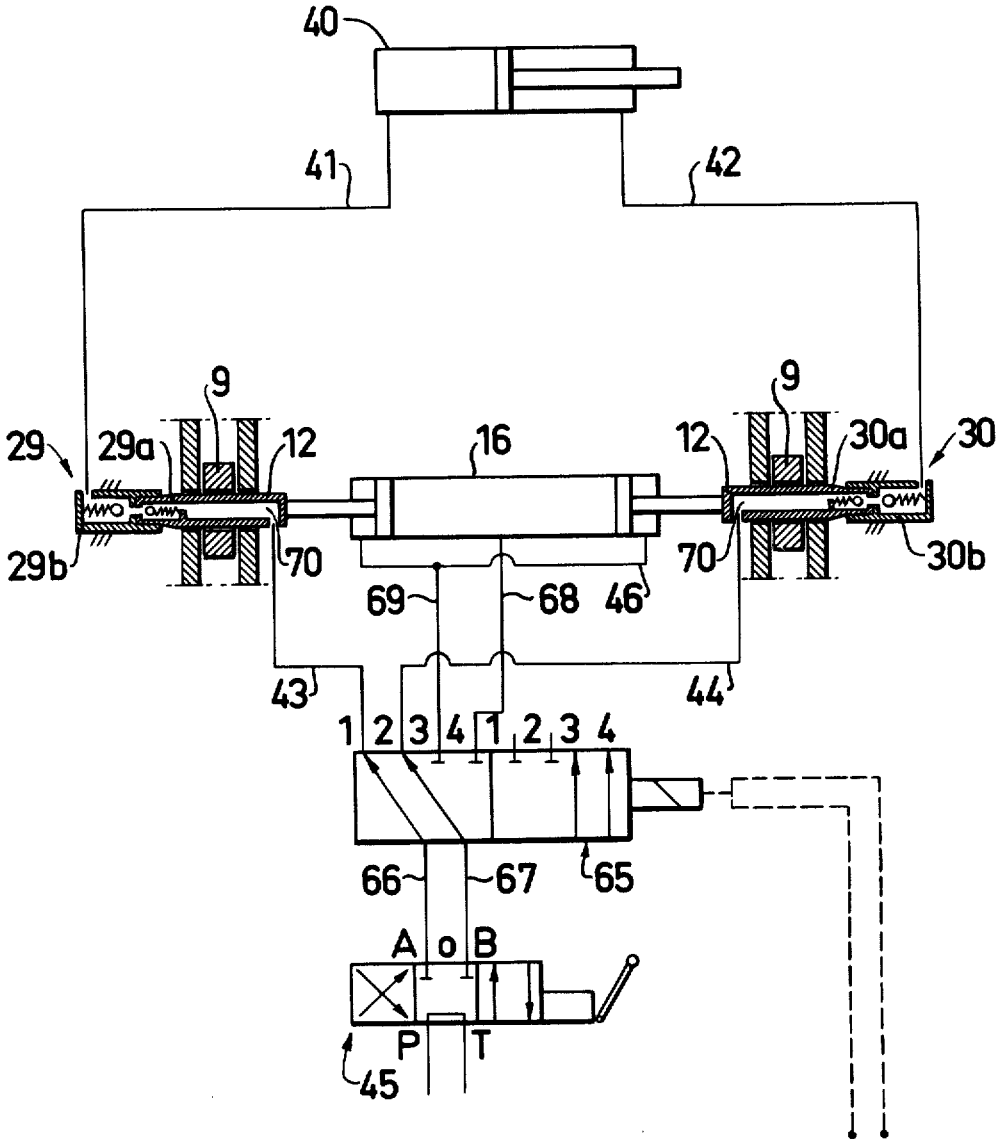
Figure 10:
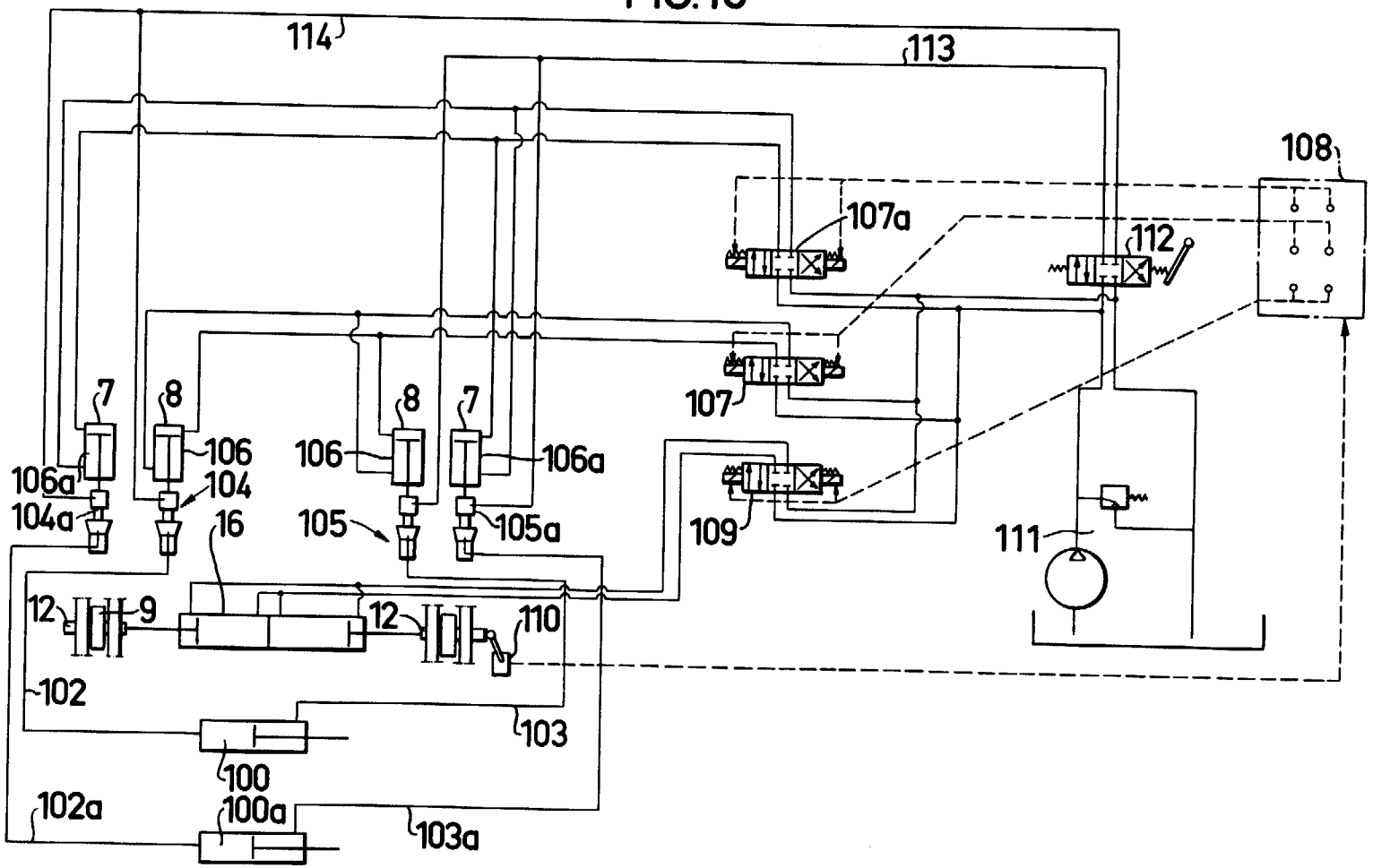
Figure 11:
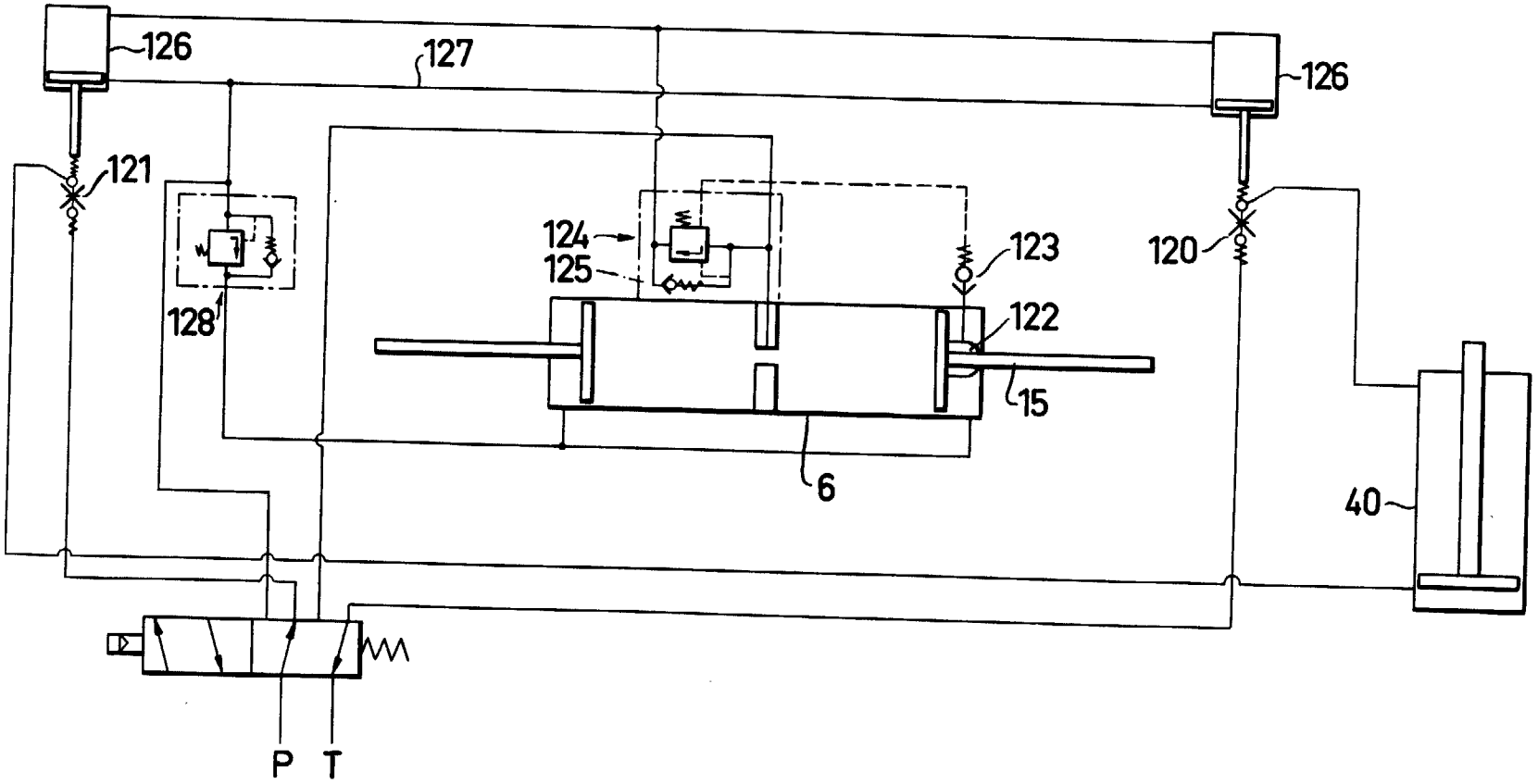
Figure 12:
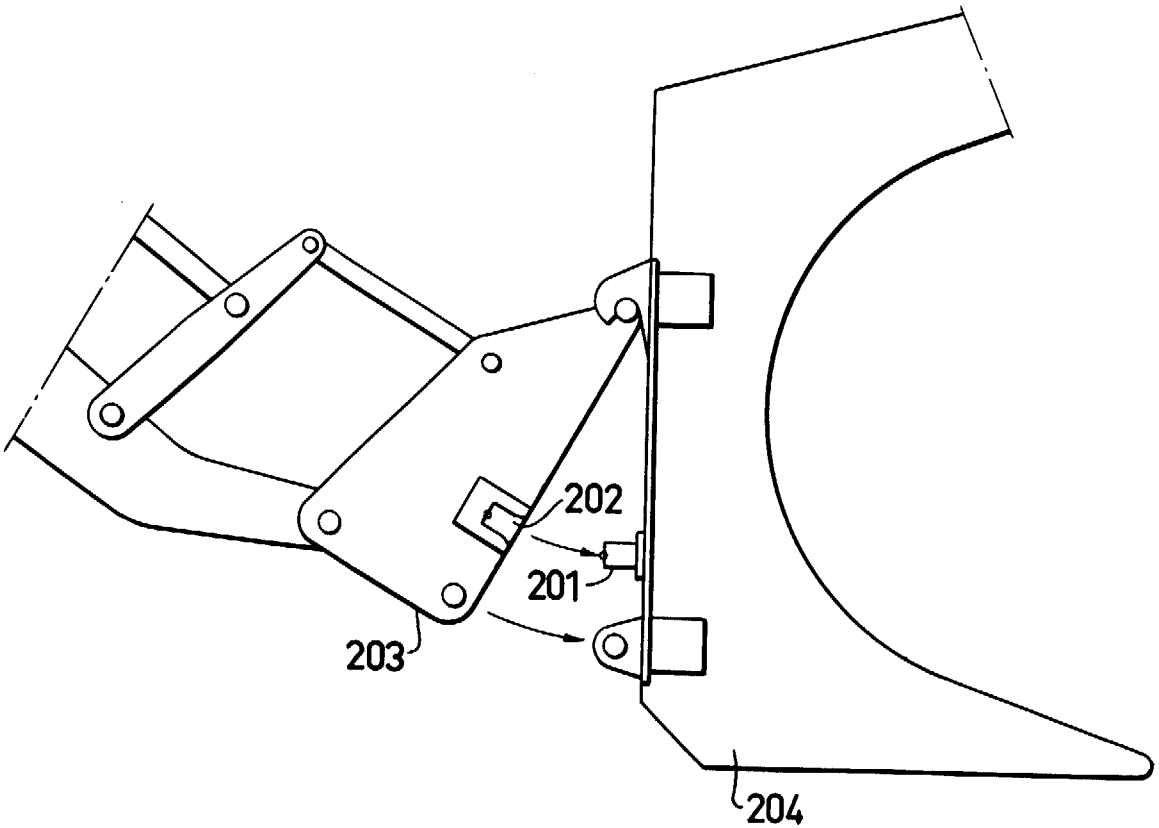

FIGS. 9, 10 and 11 illustrate three further embodiments of hydraulic coupling diagrams for a quick-coupling device; and FIG. 12 is a view, similar to FIG. 1, illustrating a further embodiment of a tool attachment supported on the lifting arms of a loader.

In FIG. 1 the numeral 1 designates a tool attachment, which in known manner by means of trunnions 2 is pivotally supported at the end of the lifting arms 3 of a loader, and the pivotal movement of which about said trunnions 2 is effected by means of one or more hydraulic cylinders (not shown) via a linkage 4, which by means of tilt arms 5 is hingedly connected to the tool attachment 1 at some distance from the swing axis thereof. The numeral 7 designates a mounting means formed on the tool 6 for the tool attachment 1, which mounting means in a manner known per se is provided with holding hooks 8 and holding eyes 9, and which at the embodiment shown has curved shape like the tool attachment 1, with support surfaces 10 facing toward each other. When the tool 6, which in FIGS. 1 and 2 is indicated in the form of a timber grapple, is being coupled together with the tool attachment 1, said attachment is lifted so that its upper carrying boom 11 (see FiGS. 3 and 4) is caused to abut inside the holding hooks 8 and the mounting means 7 of the tool, whereafter the tool attachment 1 is swung inward to the tool about the carrying boom 11 and abuts the mounting means 7. At this position the holding eyes 9 of the mounting means are located with their hole each directly in front of a locking pin 12 comprised in the quick-coupling device and between guide sleeves 14 fastened on the stand 13 of the tool attachment for the respective locking pins 12, see especially FIGS. 3 and 4 where the two locking pins 12 are shown in locking and open position, respectively, and the holding eyes 9 are not shown. When the tool attachment 1 is being swung inward to the mounting means 7 of the tool, thus, the locking pins 12 shall be in the position shown in FIG. 4.

The two locking pins 12 are connected each to a piston 15 in one and the same double-acting hydraulic cylinder 16, comprising connections (not shown) for supplying hydraulic oil either between the two pistons 15 or at the two ends of the cylinder. When, thus, hydraulic oil under pressure is fed into the cylinder 16 between the two pistons, the pistons are moved away from each other and thereby cause the two locking pins 12 to lock the holding eyes 9 of the mounting means 7 of the tool, which eyes are inserted between the guide sleeves 14. When hydraulic oil under pressure is supplied at the two ends of the cylinder the two pistons 15 are returned and the mechanical locking is released, so that the tool attachment 1 can be removed from the tool 6.

At the embodiment shown in FIG. 3 the locking pins co-operate each with a guide pin 20, which are coaxial with the respective locking pin and supported movably in slide bushings 21 attached to the stand. Two drawing bars 22, 23 are mounted in parallel with the two locking pins 12 in slide bushings 19 attached to the stand 13, of which bars the bar 22 is connected via an intermediate piece 24 to the right-hand guide pin 20, while the bar 23 is connected to the left-hand guide pin 20 via an intermediate piece 24. Each drawing bar 22 and 23 is actuated by a spring 25 shown compressed in FIG. 3 or by a corresponding member, which is clamped between a plate 26 screwn on the stand 13 and the intermediate piece 24 and is held centered by a projection 27 attached to the plate 26. On each drawing bar 22, 23 a coupling piece 28 is secured, which includes one portion 29*a* and 30*a*, respectively, (hereinafter called male portion) of a hydraulic hose coupling of quick-coupling type located in a protective sleeve 31, the other portion 29*b* and 30*b*, respectively, of which, i.e. the female portion, is located on the mounting means 7 of the tool, as shown in FIG. 2.

The coupling piece 28 shown in section in FIG. 3 and supporting the male portion 30*a* is connected to the drawing bar 23, and the coupling portion 28 visible in an opening 34 in a cover sheet 35 and supporting the male portion 29*a* is connected to the drawing bar 22. When the pistons 15 in the hydraulic cylinder 16 are moved in the direction away from each other, after a certain predetermined delay the drawing bars 22 and 23 are caused to move in opposed directions against the action of a respective spring 25, and thereby the two coupling pieces 28 are moved to each other and cause the male portions 29*a* and 30*a* of the hydraulic hose couplings to engage with the corresponding female portions 29b and 30b, respectively. It is to be observed that this takes place after the mechanical locking by means of the locking pins 12 has been effected. The female portions 29b and 30b of said two hose couplings are not shown in detail in FIG. 3 or 4, but are as shown in FIG. 2 stationary provided at a guide block 36 on the mounting means 7 of the tool. Said guide block 36, which includes passageways (not shown) connecting the female portions to conduits to and from the hydraulic cylinder or cylinders of the tool, and which is spring-suspended or in some other way movably mounted in a holder 37 attached to the mounting means 7, is arranged so as to be guided into a corresponding guide block 38 on the tool attachment 1 when the tool attachment 1 is being swung inward to the mounting means 7 of the tool. In order to facilitate this guiding movement, at least the guide block 36 can be formed with a bevelled end portion. The guide block 38 on the tool attachment is shown in greater detail in FIGS. 3 and 4 and is provided with recesses 39 for the female portions 29a and 30a. When the tool attachment 1 has been caused to abut the mounting means 7, the male and female portions 29a, 30a and 29b, 30b of the two hydraulic hose couplings are located accurately aligning. When at this position the drawing bars 22 and 23 are moved by the pistons 15 sliding apart in the hydraulic cylinder 16, the male portions 29a and 30a of the hose couplings are inserted into the respective female portion 29b and 30b, whereby an automatic coupling of the hydraulic control system for the hydraulic cylinder or cylinders on the tool is effected. In FIG. 7 a hydraulic coupling diagram for the embodiment of the device according to the invention shown in FIG. 3 is shown which also applied to the embodiment according to FIGS. 4 and 5 and 6. In FIG. 7, the hydraulic cylinder of the tool is designated by 40, and by conduits 41 and 42 the cylinder is connected to the female portions 29b and 30b, respectively, of the two hydraulic hose connections. The hose connections 29 and 30, further, are connected by their male portion each via a conduit 43 and 44, respectively, to a control valve 45 provided in the loader or tool carrier with two operation positions A and B and an O-position or neutral position, which valve via a conduit P is connected to an oil pump and via a return conduit T to an oil tank. The connecting conduit to the two ends of the hydraulic cylinder 15 is designated by 46 and connected to the conduit 44. The conduit 43 is connected to the hydraulic cylinder 16 between its two pistons 15 via a pilot-controlled check valve 47. For the control of the check valve 47 a control valve 48 is provided, which is coupled between the conduits 43 and 44 and electrically operated by a control means 48a in the loader. Said control valve has two positions I and II and is connected to the check valve 47 via a pilot conduit 49. In the connection between the control valve 48 and the conduit 43 a check valve 50 is provided which always prevents pilot pressure arising from the conduit 43, and which at position I of the control valve renders it possible to relieve pilot pressure possibly remaining in the check valve 47, so that this valve safely is held closed.

Upon coupling, the control valve 45 is set in position A, which implies that hydraulic oil under pressure is pumped via the conduit P and conduit 43 into the hydraulic cylinder 16 between its pistons 15, which thereby are moved apart and bring about the mechanical locking of the holding eyes 9 to the tool attachment and the coupling of the portions of the two hose couplings one to the other in the aforedescribed way. Prior to the coupling together of the hose couplings, the hydraulic oil in the conduit 43 is stopped by a check valve provided in the male portion of the hose coupling 29, which check valve is opened first after the hose coupling in question is coupled together. The female portions of the two hydraulic hose couplings also are provided with a check valve, which prevent the hydraulic oil in the hydraulic system of the tool to leak out when the two hose couplings 29 and 30 are being disengaged. After the coupling of the two hose couplings 29 and 30 the position A is used for moving the piston in the hydraulic cylinder 40 in one direction. By moving the control valve 45 to position B, the piston in the cylinder 40 is forced to move in the opposed direction. The control valve 48 hereby assumes position I. When the tool is to be detached from the tool attachment, the control valve 45 is moved to position B, and by means of the control means 48a the control valve 48 is moved to its position II, which implies that the check valve 47 is opened, so that hydraulic oil under pressure can be supplied via the conduits 44 and 46 to both ends of the hydraulic cylinder 16 whereby the two pistons 15 are returned to each other. When the pistons 15 now are pressed against each other, the locking pins 12 are moved from the respective guide pin 20, thereby rendering it possible for the springs 25 at the ends of the drawing bars 22 and 23 to move the drawing bars 22 and 23 so to say against each other and thereby to release the portions of the hose portions from each other, which takes place before the locking pins 12 release the holding eyes 9 on the mounting means 7 of the tool.

The embodiment of the automatic quick-coupling device according to the invention shown in FIG. 4 differs from the embodiment shown in FIG. 3 only thereby that at this embodiment the intermediate pieces 24 are fastened directly each on a locking pin 12 and each enclose a drawing bar 22, 23, which also at this embodiment are actuated by a compression spring 51 provided in a sleeve 54 in the stand 13 and clamped between a detachable plate 52 and a tubular support portion connected to the end of the drawing bar. When, thus, the locking pins 12 are moved apart and into the guide sleeves 14 for locking the holding eyes 9 on the mounting means 7 of the tool, the intermediate pieces 24 are moved along the associated drawing bar until they abut the respective tubular support portions, whereafter the drawing bars are actuated and effect the portions of the hose couplings be coupled together at the same time as the springs 51 are tightened for disconnecting the hose couplings 29 and 30 when so is desired. For this embodiment substantially the same coupling diagram can be used as for the embodiment shown in FIG. 3.

FIGS. 5 and 6 show a further modified embodiment of the automatic quick-coupling device according to the invention. At this embodiment, on each piston or piston rod 15 of the hydraulic cylinder 16 a guide roller 55 is supported between the cylinder proper and the locking pin 12. Said guide roller abuts a guide surface 56 on an arm 58 pivotal about an axle 57, which arm by means of a pressure roller 59 abuts a stop portion 60 on the coupling piece 28, which includes the male portion 29a of one quick-coupling. At this embodiment, the coupling portion 28 with its male portion is mounted movably in a bushing 61 in the stand 13, and between the bushing 61 and a locking washer 62 on the coupling piece 28 a spring 63 is clamped, which tends to press the coupling piece 28 against the pressure roller 59, and therewith the arm 58 against the guide roller 55. Directly in front of one male portion 29*a* also its female portion 29*b* is shown. When hydraulic oil under pressure is supplied between the pistons 15 of the hydraulic cylinder 16, the locking pins are moved into the respective holding eyes and at the same time the guide rollers 55 move each along a guide surface 56 on the arms 58. The arms thereby are forced to swing about their axle 57 for moving the coupling pieces 28 against the action of the compression springs 63, which hereby are tightened, and the male portions 29*a* and 30*a* of the hose couplings are coupled into the respective female portions 29*b* and 30*b*, in which coupled position they then are held by the guide rollers 55 as shown in FIG. 6. Upon movement of the guide rollers 55 in the other direction, thus, the compression springs 63 can disengage the respective hose coupling, and thereby the hydraulic connection to the hydraulic cylinders of the tool is broken.

In FIG. 8 a hydraulic coupling diagram is shown which is especially intended for the embodiment shown in FIGS. 5 and 6. A two-position six-way valve 65 here is used, to which the conduits 43 and 44 to the hose couplings 29 and 30 directly are connected, and which via conduits 66 and 67 is coupled to the control valve 45 in the loader and controlled from the loader. At this embodiment, further, the hydraulic cylinder 16 is directly connected to the valve 66 via conduits 68 and 69. At the position shown in FIG. 8, at which the hose couplings 29 and 30 are coupled, hydraulic oil under pressure thus can flow from the valve 65 via the outlet 1, conduit 63, hose coupling 29 and conduit 41 into the hydraulic cylinder 40, and the return oil from the cylinder flows via the conduit 42, hose coupling 30 and conduit 44 to the inlet 2 in the valve 65. When the opposite direction of movement for the piston of the hydraulic cylinder 40 is desired, the control valve 45 is moved from the position B shown to the position A. For coupling the tool attachment 1, the valve 65 is moved to the position indicated with 3–4, and the control valve 45 is moved to position A. For disconnecting said attachment, the control valve 45 is moved to position B, and the valve 65 shall be set in position 3–4.

In FIG. 9 a hydraulic diagram for a slightly modified embodiment is shown which differs from the embodiment shown in FIGS. 5 and 6 by the location of the hose couplings 29,30. As appears from FIG. 9, one part of the hose couplings, for example the male part 29*a*, 30*a*, is attached each to the end of a locking pin 12, and the second part of the hose couplings, for example the female part 29*b*, 30*b*, is attached to the tool directly in front of the respective locking pins. The male parts 29*a*,30*a*, thus, are moved to the locking position shown in FIG. 9 to the female part 29*b*,30*b* in question until they are coupled together therewith. This takes place at the moment when the locking pins 12 reach their final locking position or after they have reached the same, as shown in FIG. 9. The conduits 43,44 from the valve 65 are connected each to a locking pin 12, more precisely to a passageway 70 formed inwardly in the respective locking pin, which passageway in its turn communicates with the hose coupling portion 29*a* and, respectively, 30*a* connected to the associated locking pin. In the position shown in FIG. 9, in which the hose couplings 29 and 30 are connected, hydraulic oil under pressure, thus, can flow from the valve 65 via the outlet 1, conduit 43, passageway 70, hose coupling 29 and the conduit 41 connected to the female portion 29*b* of said coupling portion 29 into the hydraulic cylinder 40, from which the return oil flows to the inlet 2 of the valve via the conduit 42, hose coupling 30, passageway 70 in the locking pin 12 and the conduit 44. The conduits 43 and 44 should be of flexible type for being able to participate in the movement of the locking pins.

In FIG. 10 an embodiment is shown at which the tool is provided with two working cylinders 100 and, respectively, 100*a*. The hydraulic cylinder 100 is connected via conduits 102, 103 to a pair of hose couplings 104, 105, which are connected and disconnected each by means of a control device 106, which electrically are controlled via a control valve 107 from a control panel 108. The hydraulic cylinder 100*a* is connected in a similar way to a pair of hose couplings 104*a*, 105*a*, which are connected and disconnected each by means of a control device 106*a*, which electrically are controlled via a control valve 107*a* from the control panel 108. From said panel also a control valve 109 is controlled or actuated electrically, which corresponds to the valve 65 in the preceding embodiments and is intended for mechanically coupling together the tool carrier with the tool by means of the locking pins 12 movable to engage with the holding eyes 9 of the double-acting hydraulic cylinder 16.

The operator actuates from the control panel 108 the control valve 109 so that the valve permits hydraulic oil to flow into the hydraulic cylinder 16 between its pistons. The pistons move the locking pins to the locking position shown in FIG. 10 and bring about the mechanic coupling effect between the tool carrier and the tool. When the locking pins 12 have assumed this position, a transducer 110 connected to one locking pin is actuated and caused to emit a signal to the control panel 108, thereby indicating for the operator that the mechanic coupling-together operation has taken place. It is thereby possible for the operator to connect the hose couplings 104, 104*a*, 105, 105*a* by causing from the control panel 108 the control valves 107, 107*a* to pass hydraulic oil to the control devices 106, 106*a*. Said devices thereby move together the respective hose couplings 104, 104*a*, 105, 105*a*. Hydraulic oil now can flow to the working cylinders 100, 100*a* from the hydraulic system 111 of the tool carrier via the control valve 112 of the tool carrier, the conduit 113, hose couplings 105, 105*a* and conduits 103, 103*a* and again to the hydraulic system 111 via the conduits 102, 102*a*, hose couplings 104, 104*a*, a conduit 114 and the control valve 112.

For separating the tool from the tool carrier an interlocking should be provided, in such a manner, that the separation of the hose couplings by the control devices 106, 106*a* always takes place before the mechanic disconnection, i.e. before the locking pins 12 can be moved from the locking position.

At this embodiment, thus, the operator can decide when the cylinders are to be connected and which one or ones of the working cylinders should be connected.

In FIG. 11 a further embodiment is shown, at which the connection of the hose couplings 120, 121 is controlled by a control cam 122 on one of the piston rods 15 of the double-acting hydraulic cylinder 16. When this piston rod is in its outer end position, the control cam 122 causes a check valve 123 to open, so that hydraulic oil can flow to an overflow valve 124 provided with a check valve 125, so that the overflow valve opens and permits hydraulic oil to pass to control devices 126 for the hose couplings 120, 121 and cause said devices to move together the hose couplings. In the return conduit 127 from the control devices 126 also an overflow valve 128 is provided which is similar to the valve 124 and is used when the hose couplings are to be disconnected.

In FIG. 12 is shown that it is possible according to the invention to move together also two portions 201 and 202 of a hose coupling by utilizing a movement of the tool carrier 203 in the direction to the tool 204.

The present invention is not restricted to the embodiments described above and shown in the drawings, but can be altered and modified and combined in many different ways within the scope of the attached claims.

What I claim is:

1. A coupling between a tool attachment adapted to be supported on a carrier and tool mounting means fitting the tool attachment and adapted to support a tool, said tool mounting means carrying a fixed latch member and said tool attachment carrying a movable latch member which, when said tool attachment and said tool mounting means are in engagement, is movable into and out of locking engagement with said fixed latch member; means for moving said latch member between locking and unlocking positions to thereby couple and decouple, respectively, said tool attachment and said tool mounting means; a hydraulic control circuit for supplying power to a tool supported on said tool mounting means, said circuit including a pair of two-part hose couplings, one part of each coupling being stationary on said tool mounting means and the other part carried on and movable relative to said tool attachment; and means for moving the movable hose coupling parts relative to said tool attachment, in response to locking and unlocking movement of said movable latch member, in a manner such that during a coupling operation the hose coupling parts of each pair become engaged only after said movable latch member has arrived at a locking position and such that during a decoupling operation the coupling parts of each pair become disengaged before said movable locking member moves out of its locking position.

2. A coupling as in claim 1 wherein said movable latch member includes a locking pin, wherein said stationary latch member includes an eye, and wherein said means for moving said movable latch member includes a hydraulic cylinder and piston unit.

3. A coupling as in claim 1 wherein said means for moving the movable hose coupling parts includes a pivotable arm which swings in response to movement of said movable latch member, said arm cooperating with a movable hose coupling part so that movement of said arm results in movement of said movable hose coupling part.

4. A coupling as in claim 3 including a spring biasing said movable hose coupling parts in directions away from said stationary hose coupling parts.

5. A coupling as in claim 1 wherein said means for moving the movable hose coupling parts includes a draw bar which is longitudinally slidable in locking and unlocking directions, said draw bar being connected to the movable hose coupling parts, said draw bar being slidable upon movement of said movable latch member.

6. A coupling as in claim 5 including a spring biasing said draw bar toward its unlocking position.

7. A coupling as in claim 1 wherein said means for moving the movable hose coupling parts includes a movable element movable between a first position in which it forces said movable hose coupling parts into engagement with the stationary hose coupling parts and a second position in which the coupling parts of each pair are separated, said movable element cooperating with said movable latch member in a manner such that said element is moved to its first position after said movable latch member has engaged said stationary latch member.

* * * * *